US006145175A

United States Patent [19]

Enneking et al.

[11] Patent Number: 6,145,175

[45] Date of Patent: Nov. 14, 2000

[54] MODULAR CASKET

[75] Inventors: John R. Enneking, Batesville, Ind.; Daniel J. McAtee, Hamilton; David J. Wellman, Cincinnati, both of Ohio

[73] Assignee: Batesville Services, Inc., Batesville, Ind.

[21] Appl. No.: 09/255,200

[22] Filed: Feb. 22, 1999

Related U.S. Application Data

[60] Provisional application No. 60/075,507, Feb. 23, 1998.

[51] Int. Cl.[7] ..... A61G 17/00

[52] U.S. Cl. ..... 27/4; 27/19

[58] Field of Search ..... 27/2, 4, 19, 35; 220/4.28, 6, 4.26, 4.27, 23.91; 229/923, 922; 206/515, 517

[56] References Cited

U.S. PATENT DOCUMENTS

| | | |
|---|---|---|
| 768,481 | 8/1904 | Post . |
| 2,950,852 | 8/1960 | Hutchinson . |
| 3,220,080 | 11/1965 | Connelly . |
| 3,729,786 | 5/1973 | Walding . |
| 3,782,619 | 1/1974 | Dittbenner . |
| 3,904,106 | 9/1975 | Elder . |
| 3,969,798 | 7/1976 | Sahlin . |
| 4,151,630 | 5/1979 | Havey . |
| 4,156,956 | 6/1979 | Partridge et al. . |
| 4,170,054 | 10/1979 | Ruffner et al. . |
| 4,193,533 | 3/1980 | Schulman . |
| 4,244,508 | 1/1981 | Schulman . |
| 4,399,596 | 8/1983 | Parlour et al. . |
| 4,765,535 | 8/1988 | Michetti . |
| 4,967,455 | 11/1990 | Elder . |
| 5,035,032 | 7/1991 | Nutting . |
| 5,044,547 | 9/1991 | Hartman . |
| 5,111,559 | 5/1992 | Mohr et al. . |
| 5,454,141 | 10/1995 | Ozbun et al. . |
| 5,586,679 | 12/1996 | Thomas . |
| 5,623,752 | 4/1997 | Gillard et al. . |
| 5,771,549 | 6/1998 | Saaf ..... 27/4 |
| 5,815,898 | 10/1998 | Jenkins ..... 27/4 |

FOREIGN PATENT DOCUMENTS

| | | |
|---|---|---|
| 1388141 | 3/1975 | United Kingdom . |
| WO94/03140A1 | 2/1994 | WIPO . |

*Primary Examiner*—Terry Lee Melius
*Assistant Examiner*—William L. Miller
*Attorney, Agent, or Firm*—Wood, Herron & Evans, L.L.P.

[57] ABSTRACT

A cardboard material casket including a cardboard material inner box having a bottom, two opposed sides and two opposed ends. A cardboard material outer wrap has an outer directed side with a finish different from a finish of the cardboard material inner box. The outer wrap has a bottom located below the bottom of the inner box. Side and end walls of the outer wrap extend from the bottom of the outer wrap up and over outer surfaces of the side and end walls of the inner box and then down and over inner surfaces of the side and end walls of the inner box. The outer directed surfaces of the bottom and side and end walls of the casket box and inner surfaces of the side and end walls of the casket box present the finish of the outer directed side of the outer wrap.

27 Claims, 6 Drawing Sheets

MODULAR CASKET

This application is a continuation of provisional application Ser. No. 60/075,507 filed Feb. 23, 1998 for a Modular Casket.

BACKGROUND OF THE INVENTION

This invention relates to caskets and more particularly, to an improved casket to be used for cremation.

It is known to make a casket of combustible materials for the cremation of human remains. Further, it is preferable that the use of metals, for example, staples, screws and other fasteners and metal hinges and other hardware, be avoided in the casket construction. During cremation, metal may sear or fuse with pieces of bone which are difficult to separate after cremation. Further, there are environmental concerns with regard to gasses emitted during the cremation process, and therefore, it is further desirable to minimize the use of adhesives, metals, plastics or other materials which may produce noxious gasses of combustion during the cremation process.

It is further known to make caskets of corrugated fiberboard; however, most of those known corrugated fiberboard caskets include either metals, adhesives, plastics or are preferably assembled utilizing automated machinery. Further, most such caskets are manufactured and assembled at a plant by the casket manufacturers and shipped as an assembled unit to the funeral homes. Such caskets are relatively expensive and generally cost over five hundred dollars.

As an alternative, a plain brown cardboard casket is available that costs less than fifty dollars. However, that casket, while functional, is not appealing or attractive in use. Thus, while less expensive fiberboard or cardboard constructed caskets are commercially available, they are either very plain and aesthetically undesirable or more attractive but relatively expensive. Consequently, there is a need for a casket that is reasonably attractive in appearance but priced in between the casket products currently available.

SUMMARY OF THE INVENTION

The present invention provides a casket that is environmentally responsible, less expensive and reasonably attractive. Further, the modular design makes the casket easy and compact to store in an unassembled state. Further, when required, the casket is easily assembled without tools, adhesives or fasteners for immediate use. The casket of the present invention is especially useful as a cremation casket.

In accordance with the principles of the present invention and the described embodiments, the present invention provides a cardboard material casket including a cardboard material inner box having a bottom, two opposed sides and two opposed ends. A cardboard material outer wrap has an outer directed side with a finish different from a finish of the cardboard material inner box. The outer wrap has a bottom located below the bottom of the inner box. Side and end walls of the outer wrap extend from the bottom of the outer wrap up and over outer surfaces of the side and end walls of the inner box and then down and over inner surfaces of the side and end walls of the inner box. The inner box and outer wrap assembly form opposed side and end walls of an open casket box with outer directed surfaces of the bottom and side and end walls of the casket box and the inner surfaces of the side and end walls of the casket box presenting the finish of the outer directed side of the outer wrap.

In one aspect of the invention, a cardboard material lid has a top and side and end walls with all outer directed surfaces having the finish of the outer wrap. The lid covers either a portion or all of the open casket box, and the side and end walls of the lid extend over respective side and end walls of the open casket box.

In another aspect of the invention, the two opposed side walls of the inner box have end pieces extending from opposite ends thereof, and the end pieces are disposed within the two opposed end walls of the inner box.

In a further aspect of the invention, the two opposed side walls of the outer wrap have end pieces extending from opposite ends thereof, and the end pieces are disposed proximate the two opposed end walls of the inner box.

These and other objects and advantages of the present invention will become more readily apparent during the following detailed description taken in conjunction with the drawings herein.

DETAILED DESCRIPTION OF THE INVENTION

Figure 1:
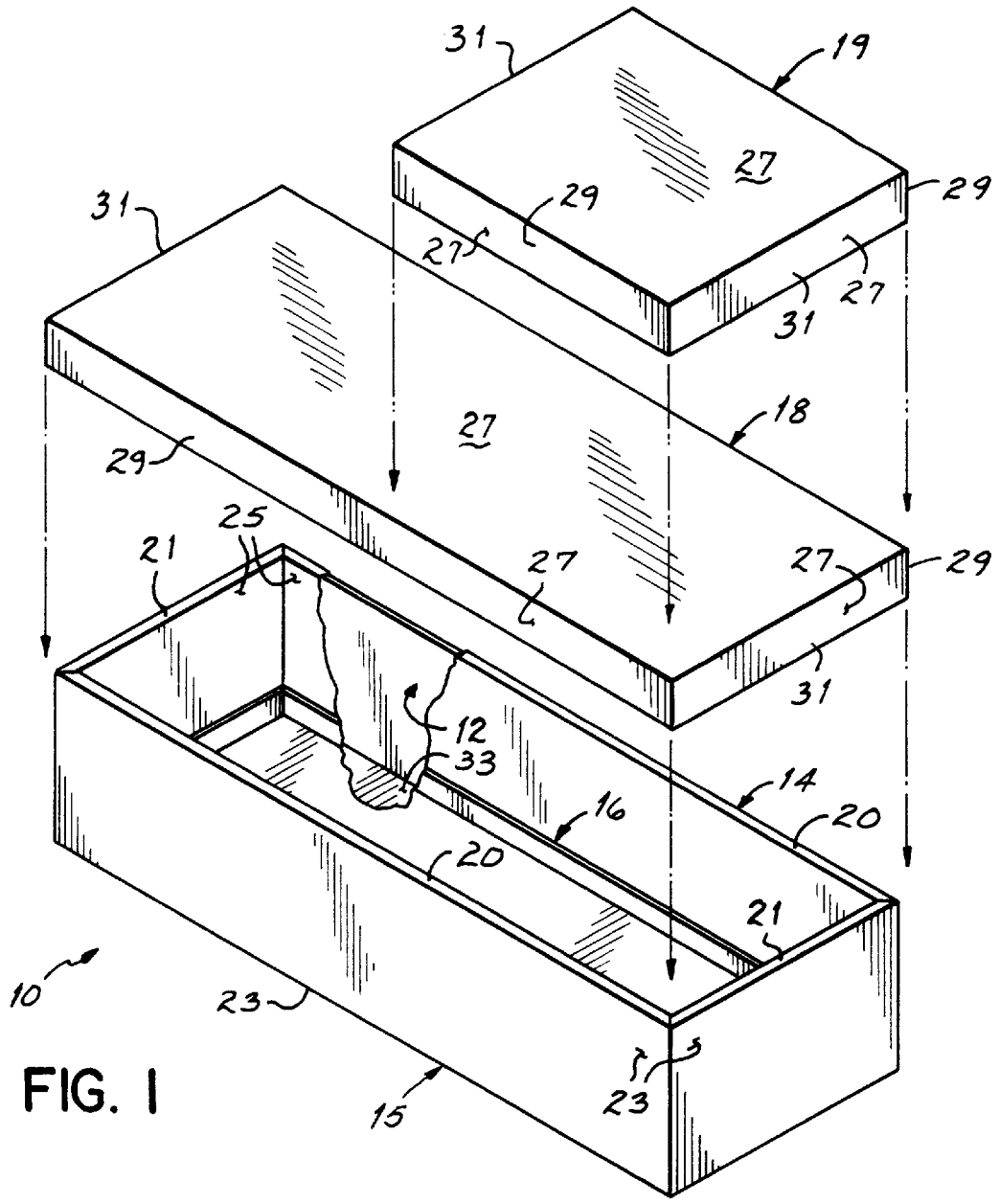
FIG. 1 is an overall perspective view of a modular casket in accordance with the principles of the present invention.

Referring to FIG. 1, a modular casket 10 is comprised of five modular pieces, that is, an inner container or box 12, an outer box or wrap 14, an inner tray 16 and either a full lid 18 or a partial lid 19. The inner box 12 and outer wrap 14 are assembled together to form an open casket box 15 having a bottom 33, opposed side walls 20 and opposed end walls 21. The full lid 18 is fitted over the casket box 15 so that the sides 29 and ends 31 extend over the respective sides 20 and ends 21 of the casket box, thereby completely covering the casket box 15. Alternatively, the half lid 19 is similarly fitted over the casket box 15 to partially cover the open casket box 15 for viewing purposes. Each of the modular pieces 12, 14, 16, 18, 19 is made from a cardboard-type of material. The outer directed surfaces 23 of the bottom 33 and side and end walls 20, 21 of the casket box 15 and the inner surfaces 25 of the side and end walls of the casket box 15 all present a finished outer directed side of the outer wrap 14. The outer directed surfaces 27 of the lids 18, 19 have the same finish as the outer directed surface of the outer wrap 14. The finished surfaces 23, 25, 27 are more visually appealing than a standard brown cardboard color.

Figure 2:
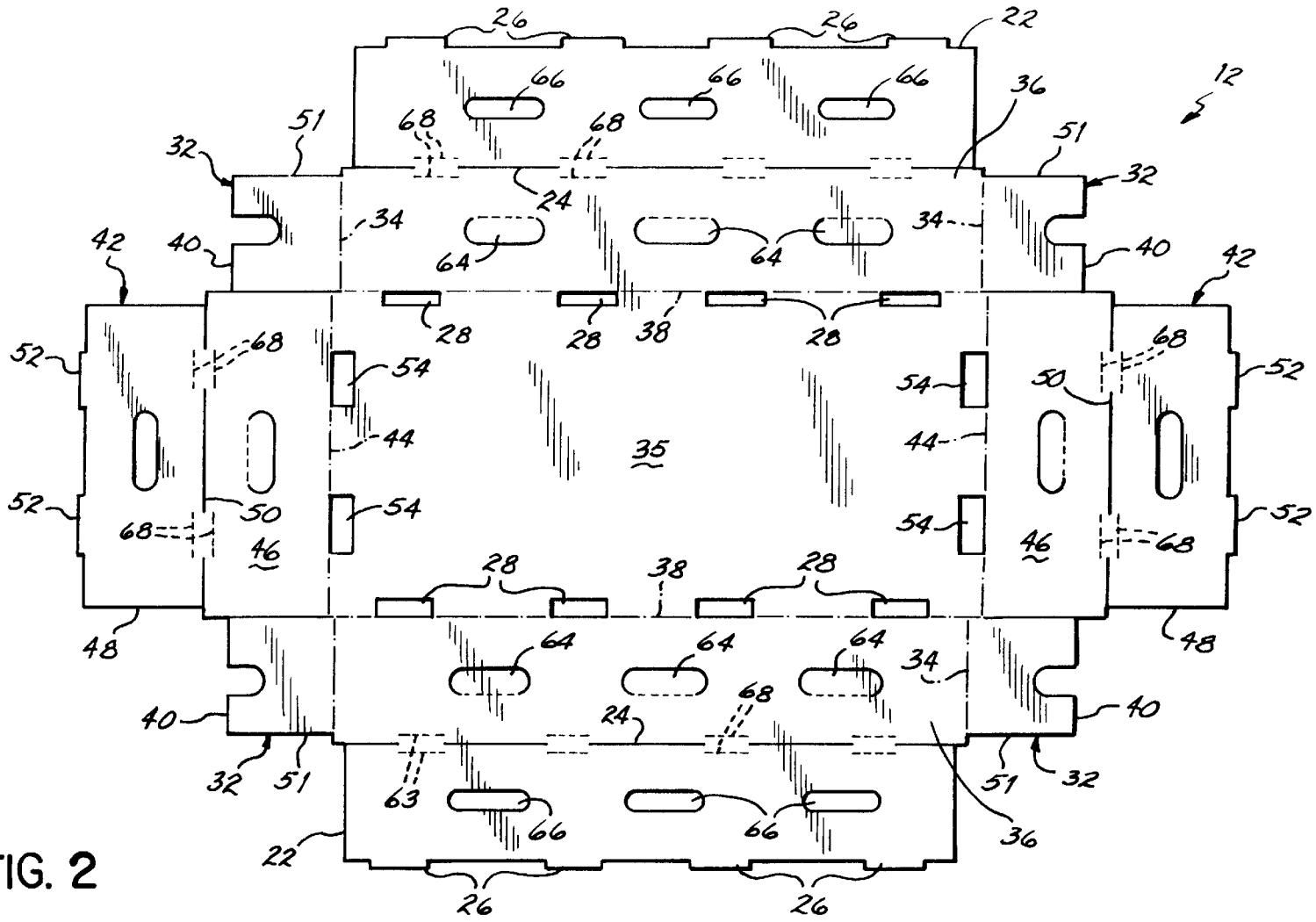
FIG. 2 is a layout of an inner casket box of the modular casket.
Figure 7:
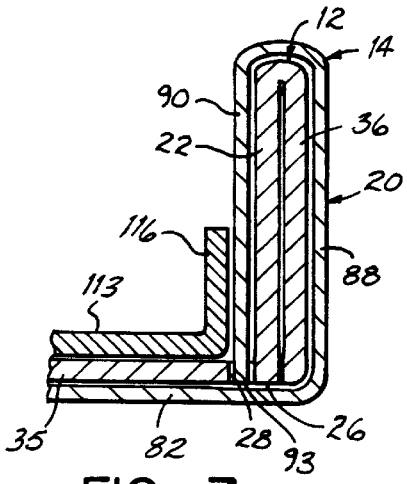
FIG. 7 is a cross-sectional view of a side wall assembly of the inner box, outer wrap and tray of the modular casket.

Referring to FIGS. 2 and 7, the inner box 12 is illustrated as an unfolded flat sheet of cardboard, preferably 200 pound, double walled, that is, double fluted cardboard, approximately 0.3125 inches thick. To assemble the inner box 12, it is normally laid on a flat horizontal surface, and first, the side flaps 22 extending from upper edges of side panels 36 are folded 180° at fold or score lines 68 over the side panels 36. Side panels 36 extend from side edges of a bottom 35 of the inner box 12. Slits 24 separate the side flaps 22 from the side panels 36 to facilitate folding the side flaps along the fold lines 68 over the side panels 36. Next, the split ends 32 extending from opposed ends of side panels 36 are bent upward approximately 90° along respective fold lines 34. Thereafter, the folded side flaps 22, and side panels 36 are folded upward together approximately 90° with respect to the bottom 35 along fold lines 38. Edge tabs 26 on the side flaps 22 are then inserted into notches or slots 28 on the bottom 35 to form a portion of the opposed side walls 20 of the modular casket 10.

Figure 8:
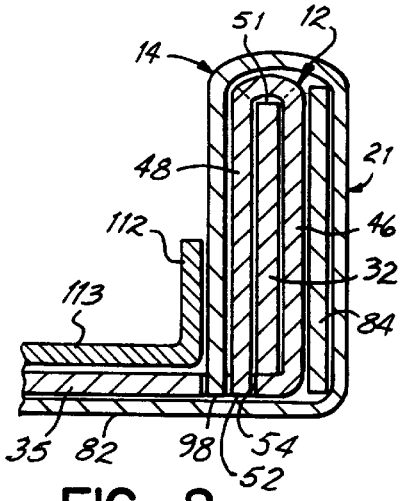
FIG. 8 is a cross-sectional view of an end wall assembly of the inner box, outer wrap and tray of the modular casket.

Referring to FIGS. 2 and 8, the now vertical split ends 32 are oriented to butt each other along edges 40 to form an end wall section of the box 10. End pieces 42 comprise end panels 46 that extend at lower edges from ends of the bottom 35 and end flaps 48 that extend from upper edges of the end panels 46. The end pieces 42 are folded upward approximately 90° with respect to the bottom 35 along fold lines 44 such that the end panels 46 are adjacent the outer sides of the abutting split ends 32. The end flaps 48 are then folded at fold lines 68 approximately 180° over the upper edges 51 of the split ends 32 and vertically downward adjacent the inner directed surfaces of the split ends 32. Thus, the split ends 32 are located between the end panels 46 and the end flaps 48 of the inner box. Slits 50 separate the end flaps 48 from the end panels 46 to facilitate folding the end flaps 48 along the fold lines 68 over the split ends 32. Edge tabs 52 on the end flaps 48 are then inserted into the notches or slots 54 to form the remainder of the end walls 21. Thus, an inner casket box 12 is quickly manually assembled without tools and has the size and strength to receive a human body. Normally, all of the fold lines are crush score lines except for the junction of the fold lines 34 of corner pieces 32 with the side 36 and the fold lines 68 which are cut score lines to facilitate folding the double fluted walls.

Figure 3:
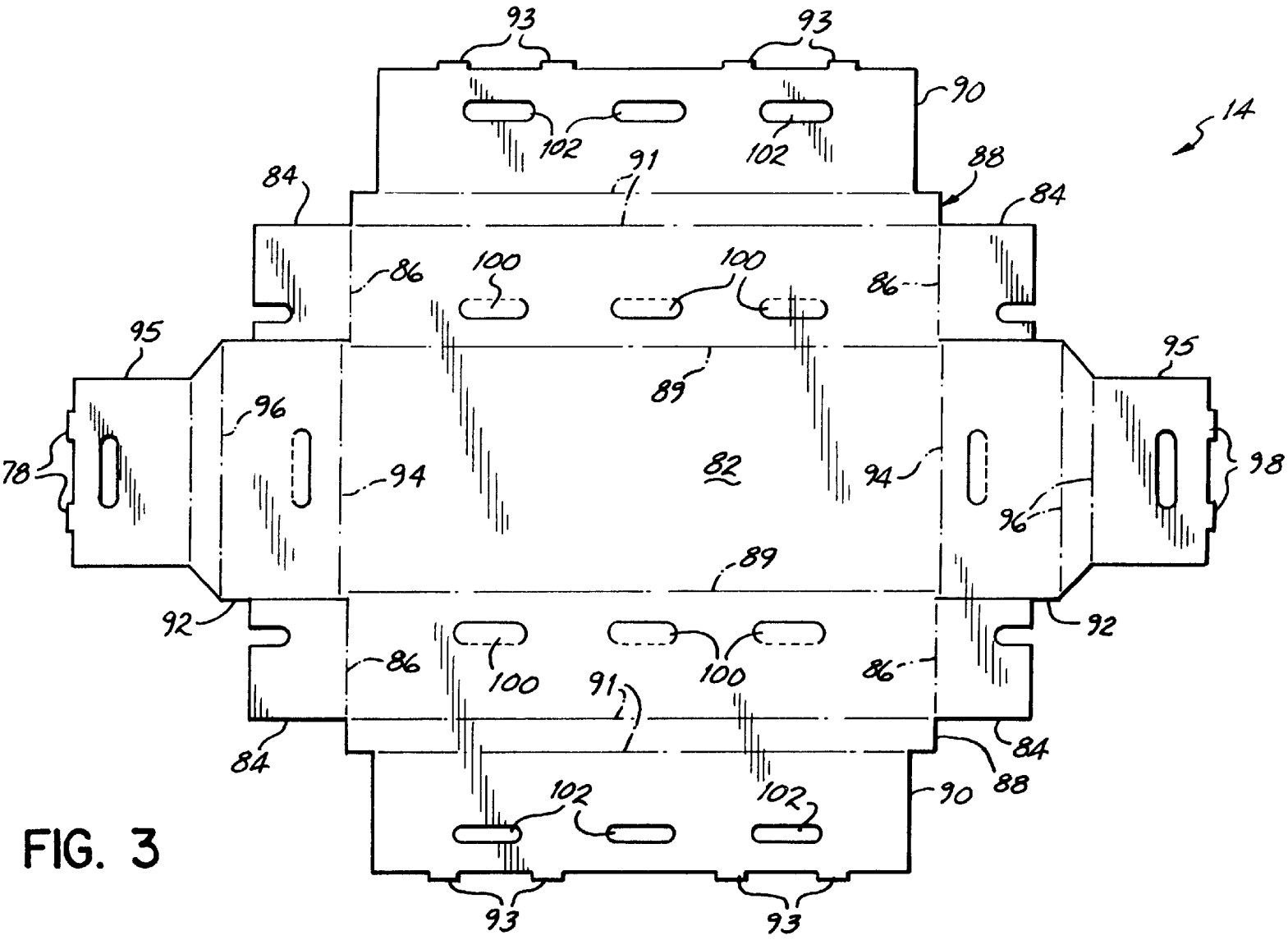
FIG. 3 is a layout of an outer wrap of the modular casket.

While the inner box 12 is structurally suitable for a casket, its visual appearance is of the brown cardboard color and is visually unappealing. Referring to FIG. 3, an outer wrap 14 is illustrated as an unfolded sheet. The outer wrap is normally made of a 200 pound, single walled, that is, single fluted, cardboard, approximately 0.125 inches thick. The outer wrap has one side of the standard brown color and a finished opposite side, for example, a high gloss grey color. The color and gloss are applied by using known commercially available processes. Thus, the outer wrap 14 is oriented so that the finished side is directed outward to be presented on the exposed surfaces.

To assemble the outer wrap 14, referring to FIGS. 3 and 7, the unfolded wrap is generally placed in a horizontal position with the unfinished side facing upward. The inner box 12 is then placed over the inner wrap 14 with the inner box bottom 35 centered on the bottom 82 of the outer wrap 14. The outer wrap 14 is assembled in essentially the same way as the inner box 12 was assembled as previously described. The split ends 84 extending from opposite ends of side panels 88 are first folded approximately 90° along fold lines 86. The side panels 88 extend from side edges of a bottom 82 and together with side flaps 90 are folded together approximately 90° with respect to the bottom 82 along fold lines 89. The side flaps 90 extend from upper edges of the side panels 88 and are folded approximately 180° at fold lines 91 over the sides 36 of the inner box 12. Inserting the edge tabs 93 on the side flaps 90 in the slots 28 on the bottom 35 of the inner box 12 completes the construction of the side walls 20 of the casket 10.

Referring to FIGS. 3 and 8, the split ends 84 are located against the outside of the end panels 46 of the lower box. End panels 92 extending from the bottom 82 and end flaps 95 extending from the end flaps 95 are folded together approximately 90° with respect to the bottom 82 along fold lines 94. Next, the end flaps 95 are folded approximately 180° along fold lines 96 over the split ends 84 of the outer wrap and the end flaps 48 of the inner box 12. The end flaps 84 are thus located between the end panels 92 of the outer wrap 14 and the end panels 48 of the inner box 12. Edge tabs 98 on the end flaps 95 are then inserted in the slots 54 of the inner box 12 to complete the construction of the end walls 21 of the casket 10. Normally, all of the fold lines on the outer layer 14 are provided by crush score lines. If desired, the hinged flaps 100 of the outer wrap 14 may be folded together with the hinged flaps 64 (FIG. 2) of the inner box 12 through the cutouts 66 of the inner box and the cutouts 102 of the outer wrap to provide handles for the casket 10. Thus, the outer wrap 14 is quickly and easily manually assembled over the inner box 12 to provide finished exposed surfaces 23 both inside and outside of the casket 10 having a more desirable and pleasing appearance.

Figure 4:
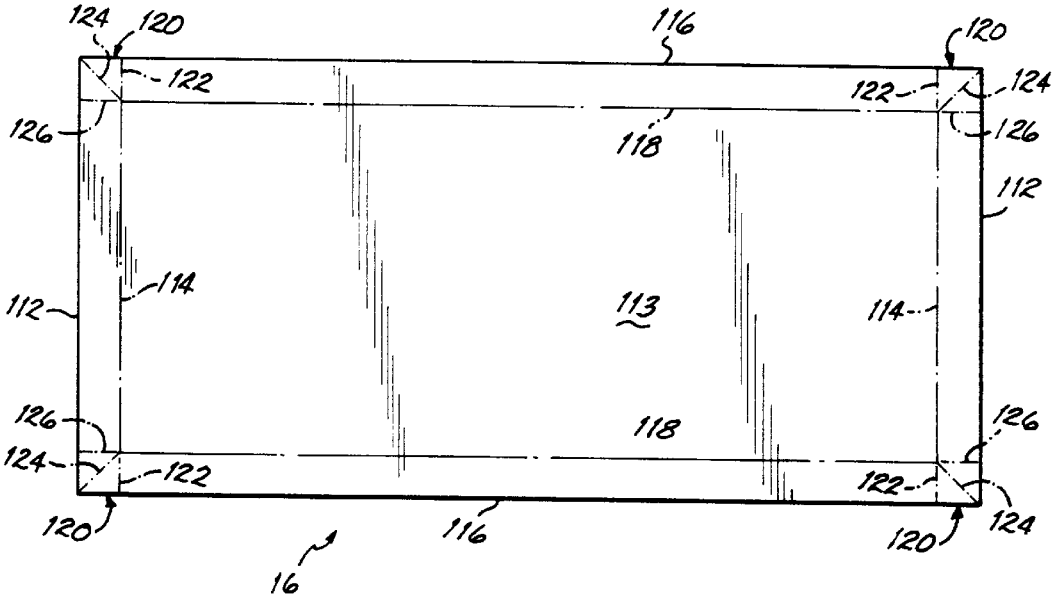
FIG. 4 is a layout of an inner tray for the modular casket.

Referring to FIG. 4, an inner tray 16 is illustrated as a flat unfolded sheet. The tray is normally made from a 200 pound, single wall cardboard having a standard brown cardboard finish on one side. The opposite side is finished in a white color and has a waterproof coating applied thereto, for example, a wax-like Michelman coating commercially available from Trey Corrugated Company of Cincinnati, Ohio. To assemble the tray 16, referring to FIGS. 4, 7 and 8, the unfolded tray is normally placed on a horizontal surface with the white coated side directed upward. The ends 112 extending from the bottom 113 are folded along approximately 90° along fold lines 114 with respect to a bottom 113. Thereafter, tray sides 116 also extending from the bottom 113 are folded approximately 90° along fold lines 118 with respect to the bottom 113. The corners 120 are simultaneously folded along fold lines 122, 124, 126 to form the desired right angled comers. The folded tray 16 is then inserted in the inner box 12 and pushed into place until its located on the bottom surface of the inner box 12.

Figure 5:
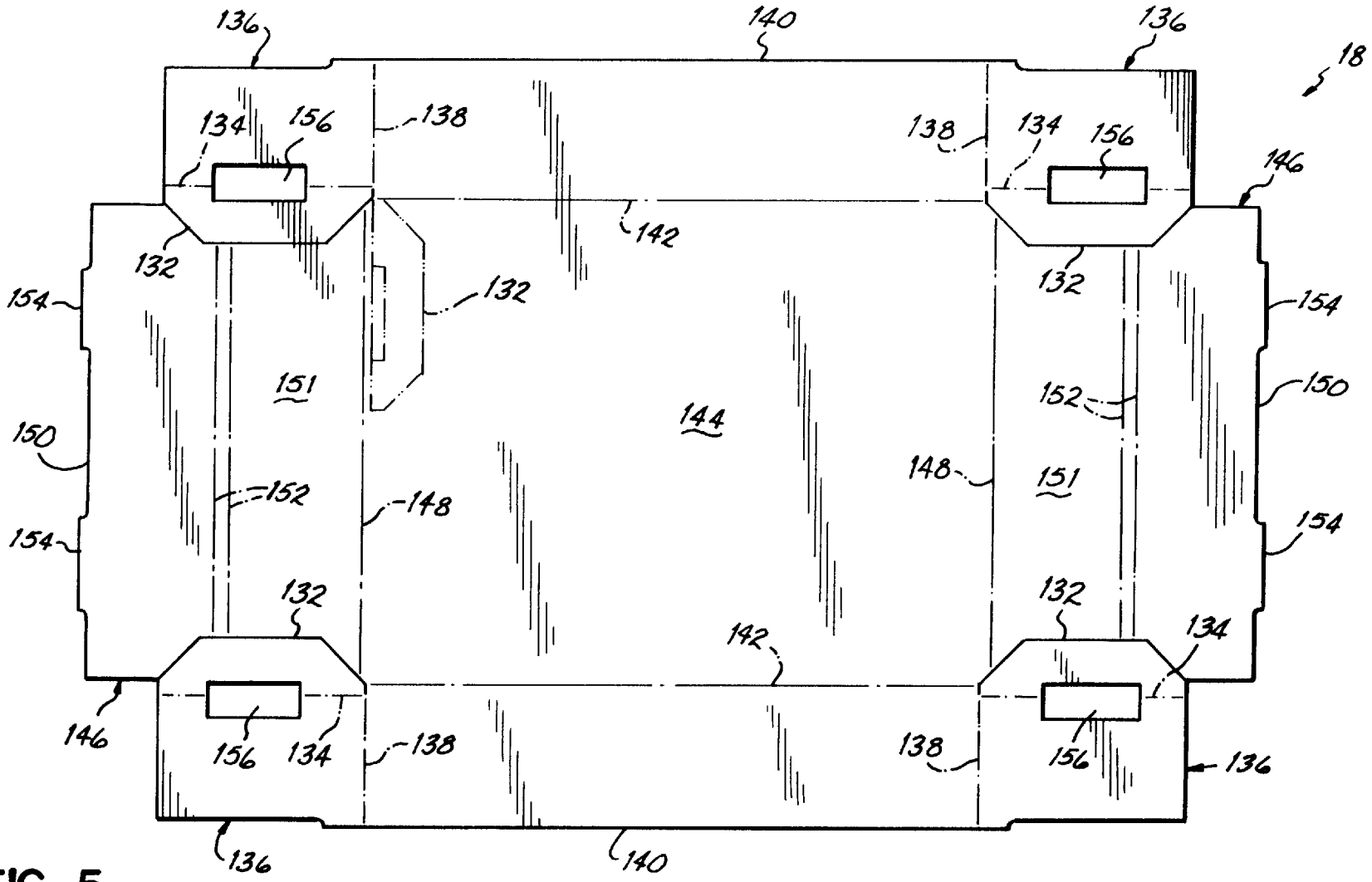
FIG. 5 is a layout of a full lid for the modular casket.
Figure 6:
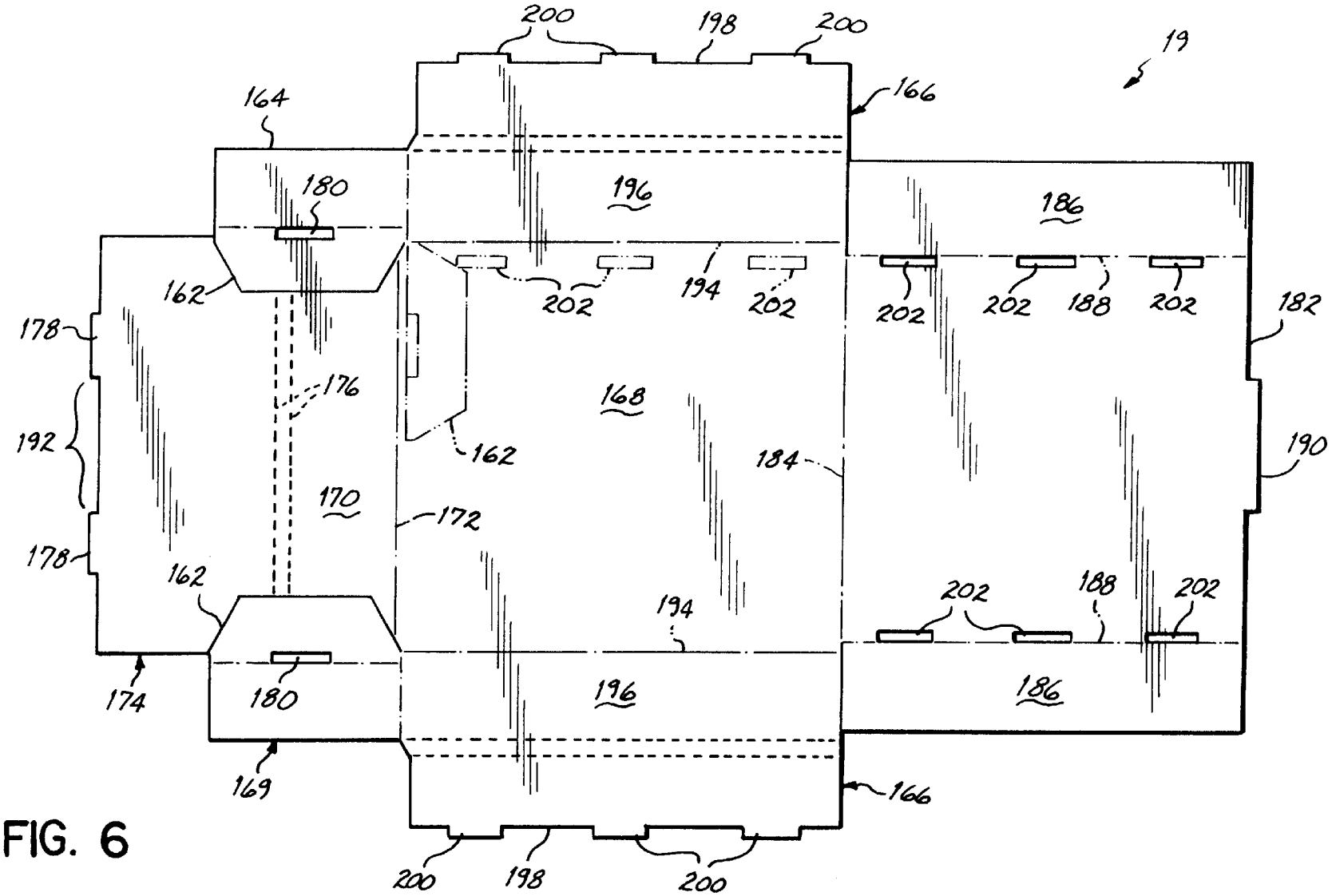
FIG. 6 is a layout of a partial lid for the modular casket.

Referring to FIG. 5, a full length lid is illustrated as a flat unfolded single piece of cardboard which has been cut and scored in accordance with the lid design. The lid 18 is made from a 200 pound, single flute or wall cardboard. One surface, that is, the interior surface of the lid 18, is finished in the standard brown cardboard color. The opposite surface, that is, the outer surface, is finished the same high gloss grey finish that is used on the outer wrap 14. To assemble the lid, the trapezoidal feet 132 are folded along fold line 134 through an angle of approximately 90°. The split ends 136 are then folded along fold lines 138 through an angle of approximately 90°. The sides 140 extending from the top 144 are then folded along fold lines 142 through an angle of approximately 90° with respect to the top 144, thereby placing the feet 132 on an interior surface of the top 144, as shown in phantom. The ends 146 also extending from the top 144 are folded along fold lines 148 through an angle of approximately 90° with respect to the top 144, and the end flaps 150 extending from end panels 151 are folded a long fold lines 152 through an angle of approximately 180° over the end panels 151. Edge tabs 154 on the end flaps 150 are then inserted in the slots 156 which are located on the top 144.

FIG. 7 illustrates a layout of a n unassembled half lid 19 which is sized to cover one-half, normally, the lower half, of the casket. The partial lid 19 is made of the identical material as the full lid 18 previously described with respect to FIG. 4. To assemble the partial lid 19, the trapezoidal flaps 162, split ends 164 and sides 166 are folded a s previously described with respect to the full lid, so that the sides 166 extend perpendicular from the top 168 and the trapezoidal flaps 162 lie on an inner surface of the top 168 as shown in phantom. The end panel 170 extending from the top 168 is folded with end flap 174 extending from an upper edge of end panel 170 along fold line 172 through an angle of approximately 90°, and the end flap 174 then is folded along fold lines 176 through an angle of approximately 180°, so that edge tabs 178 on the flap 174 can be inserted in the slots 180. Next, the end panel 182 is folded along fold line 184 upward through an angle of approximately 90°. Next, the end flaps 186 extending from end panel 182 are folded along fold lines 188 through an angle of approximately 90°, so that they extend outward away from the right end of the lid. The right end flap 182 is then folded further so that it lies flat against the top 168 and edge tab 190 on the right end 182 is inserted in the slot 192 which is now adjacent the top 168 in the lower portion of the left end wall. The side flaps 186 are now extending at right angles away from the top 168 and lying parallel to the fold lines 194. The lid side panels 196 extending from the top 168 are folded upward along fold lines 194; and the side flaps 198 extending from an upper edge of end panels 196 are folded over the upward extending end flaps 186 and downward toward the top 168. Edge tabs 200 on the side flaps 198 are then inserted in the slots 202 shown in phantom on the top 168.

In use, the five pieces of the modular casket 10 described with respect to FIGS. 1–8 are cut and scored in accordance with the desired layout design and are then packaged in a cardboard box, for example, a full flat, five panel folder, and forwarded to the funeral homes. Upon receipt, funeral home personnel are able to assemble the casket by folding the various pieces together as previously described. While the inner box 12 is structurally sound, the wrapping of the outer wrap 14 around the inner box 12 not only provides an improved appearance but also, substantially contributes to locking the pieces of the inner box 12 together. The combination of the inner box 12 and outer wrap 14 forms an open casket box 15 having substantial structural stability without the use of adhesives or fasteners. The outer directed surfaces 23 of the bottom 33 and side and end walls 20, 21 of the casket box 15 and surfaces 25 of the side and end walls of the casket box 15 all present the finished side of the outer wrap which is more visually appealing than a standard brown cardboard color. The inner tray 16 and lids 18, 19 are also easily assembled; and the outer directed finished surfaces 27 of the lids 18, 19 are also more visually appealing than a standard brown cardboard color. When the tray 16 and lids 18, 19 are placed with the assembled casket box 15, they provide a more attractive casket 10 than the basic brown cardboard casket at a price substantially less than the manufactured cardboard caskets previously discussed. The full lid 18 is used to completely cover the open casket box 15, and the half lid 19 partially covers the open casket box 15 for viewing purposes.

The modular casket design of the present invention has no metallic components in the form of staples and other fasteners and, further, has only the adhesives used in the cardboard construction and only the chemicals used in the finish. Thus, the modular casket design of the present invention provides minimal noxious or otherwise undesirable gasses of combustion. The modular casket is an environmentally responsible design which is very cremation friendly and produces a minimum of ash. Further, the modular casket may also be used as a liner for wooden or metal caskets that are rented only for visitation purposes. In addition, should it be determined that the assembled modular casket is not required, the outer wrap is easily disassembled by removing its tabs from respective slots. The inner box is likewise disassembled by removing its tabs from respective slots; and the box components stored in their unassembled state.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the split ends 32 of the inner box 12 and the split ends 84 can be positioned at locations other than those described. In an alternative embodiment the split ends 32, 84 can be located together between the end panels 46 and the end flaps 48 of the inner box 12. In another embodiment the split ends 32, 84 can be located together between the end panels 46 of the inner box 12 and the end panels 92 of the outer wrap. As will be appreciated, other combinations of locations for the split ends 32 are possible.

Further, the notches or slots 28, 54 may be cutout slots providing holes through which the tabs are inserted. Alternatively, the notches or slots 28, 54 may be sharp indentations or slits that do not extend through the cardboard material but form depressions sufficient to hold the tabs. The colors chosen for the outer wrap and the lids may be varied. In addition, the high gloss finish applied to the outer wrap and the lids may also be varied as may the waterproof coating applied to the tray.

Therefore, the invention in its broadest aspects is not limited to the specific details shown and described. Consequently, departures may be made from the details described herein without departing from the spirit and scope of the claims which follow.

What is claimed is:

1. A cardboard material casket comprising:

a cardboard material inner box having a bottom, two opposed sides and two opposed ends forming a container; and a cardboard material outer wrap separate from the inner box and having an outer directed side with a finish different from a finish of the cardboard material inner box, the outer wrap having a bottom located below the bottom of the inner box, the outer wrap having side and end walls extending from the bottom of the outer wrap up and being foldable over outer surfaces of the side and end walls of the inner box and being foldable down and over inner surfaces of the side and end walls of the inner box, the inner box and outer wrap assembly forming a bottom and opposed side and end walls of an open casket box with outer directed surfaces of the bottom and side and end walls of the casket box and inner surfaces of the side and end walls of the casket box presenting the finish of the outer directed side of the outer wrap.

2. A cardboard material casket of claim 1 further comprising a cardboard material lid having a top, side walls and at least one and end wall with all outer directed surfaces having the finish of the outer wrap, the lid covering the open casket box and the side and end walls extending over respective side and end walls of the open casket box.

3. A cardboard material casket of claim 2 wherein the lid fully covers the open casket box.

4. A cardboard material casket of claim 2 wherein the lid partially covers the open casket box.

5. A cardboard material casket of claim 2 wherein the lid is made from a single piece of cardboard material.

6. A cardboard material casket of claim 1 further comprising a cardboard material tray having a bottom and opposed side and end walls, the tray being disposed inside the open casket box for receiving a body.

7. A cardboard material casket of claim 6 wherein the tray is made from a single piece of cardboard material.

8. A cardboard material casket of claim 1 further wherein the bottom and opposed side and end walls of the open casket box being constructed manually without tools, adhesives or fasteners.

9. A cardboard material casket of claim 1 wherein the outer wrap is made from a single piece of cardboard material.

10. A cardboard material casket of claim 1 wherein the inner box is made from a single piece of cardboard material.

11. A cardboard material casket of claim 1 wherein each of the end and side walls of the inner box comprises:

a panel extending upward from the bottom of the inner box;

a flap extending from the panel and folding downward toward the bottom of the inner box.

12. A cardboard material casket of claim 11 wherein the flap extends from an upper edge of the panel.

13. A cardboard material casket of claim 11 wherein the bottom of the inner box has notches proximate the end and side walls and the flap has edge tabs inserted into the notches.

14. A cardboard material casket of claim 13 wherein each of the end and side walls of the outer wrap comprising:

a panel extending upward from the bottom of the outer wrap, and a flap extending from the panel of the outer wrap and folding downward toward the bottom of the inner box.

15. A cardboard material casket of claim 14 wherein the flap of the outer wrap extends from an upper edge of the panel of the outer wrap.

16. A cardboard material casket of claim 15 wherein the flap of the outer wrap has edge tabs inserted into the notches in the bottom of the inner box.

17. A cardboard material casket of claim 16 wherein each of the panels of the side walls of the inner box having split ends extending from opposite ends thereof, the split ends being disposed proximate the panels and the flaps of the end walls of the inner box.

18. A cardboard material casket of claim 17 wherein the split ends are disposed between the panels and the flaps of the end walls of the inner box.

19. A cardboard material casket of claim 18 wherein each of the panels of the side walls of the outer wrap have split ends extending from opposite ends thereof, the split ends being disposed proximate the end panels of the outer wrap and the end panels of the inner wrap.

20. A cardboard material casket of claim 19 wherein the split ends being disposed between the end panels of the outer wrap and the end panels of the inner wrap.

21. A cardboard material casket comprising:

a cardboard material inner box having a bottom, two opposed side walls and two opposed end walls forming a container, the two opposed side walls of the inner box having split ends extending from opposite ends thereof, and the split ends being disposed between the two opposed end walls of the inner box;

a cardboard material outer wrap separate from the inner box and having an outer directed side with a finish different from a finish of the cardboard material inner box, the outer wrap having a bottom located below the bottom of the inner box, the outer wrap having two side walls and two end walls extending from the bottom of the outer wrap up and being foldable over outer surfaces of the side and end walls of the inner box and being foldable down and over inner surfaces of the side and end walls of the inner box, the inner box and outer wrap assembly forming a bottom and opposed side and end walls of an open casket box with outer directed surfaces of the bottom and side and end walls of the casket box and inner surfaces of the side and end walls of the casket box presenting the finish of the outer directed side of the outer wrap.

22. A cardboard material casket of claim 21 wherein the two opposed side walls of the outer wrap having split ends extending from opposite ends thereof, and the split ends being disposed proximate opposed end walls of the outer wrap and opposed end walls of the inner box.

23. A cardboard material casket comprising:

a cardboard material inner box having a bottom, two opposed sides and two opposed ends forming a container; and a cardboard material outer wrap separate from the inner box and having an outer directed side with a finish different from a finish of the cardboard material inner box, the outer wrap having a bottom located below the bottom of the inner box, the outer wrap having side and end walls extending from the bottom of the outer wrap up and being foldable over outer surfaces of the side and end walls of the inner box and down and being foldable over inner surfaces of the side and end walls of the inner box, the inner box and outer wrap assembly forming a bottom and opposed side and end walls of an open casket box;

a cardboard material lid having a top, side walls and an end wall and the lid covering the open casket box with the side and end walls of the lid extending over respective side and end walls of the outer wrap, the outer directed surfaces of the bottom and side and end walls of the casket box, inner surfaces of the side and end walls of the casket box and all outer directed surfaces of the lid having the finish of the outer wrap.

24. A cardboard material casket comprising:

a cardboard material inner box having a bottom, two opposed sides and two opposed ends; and a cardboard material outer wrap separate from the inner box and having an outer directed side with a finish different from a finish of the cardboard material inner box, the outer wrap having a bottom located below the bottom of the inner box, the outer wrap having side and end walls extending from the bottom of the outer wrap up and over outer surfaces of the side and end walls of the inner box and down and over inner surfaces of the side and end walls of the inner box, the side and end walls of the outer wrap being secured in position by the inner box;

the inner box and outer wrap assembly forming a bottom and opposed side and end walls of an open casket box with outer directed surfaces of the bottom and side and end walls of the casket box and inner surfaces of the side and end walls of the casket box presenting the finish of the outer directed side of the outer wrap.

25. A cardboard material casket of claim 24 wherein the side and end walls of the outer wrap interlock with the inner box.

26. A cardboard material casket of claim 24 wherein the bottom of the inner box has openings and the side and end walls of the outer wrap have projections that are received by the openings in the bottom of the inner box.

27. A cardboard material casket of claim 26 wherein the side and end walls of the inner box have projections that are received by the openings in the bottom of the inner box.

* * * * *

UNITED STATES PATENT AND TRADEMARK OFFICE

CERTIFICATE OF CORRECTION

PATENT NO. : 6,145,175 
DATED : November 14, 2000
INVENTOR(S) : John B. Enneking, Daniel J. McAtee and David J. Wellman It is certified that error appears in the above-identified patent and that said Letters Patent is hereby corrected as shown below:

Column 4,
Line 35, "comers" should read -- corners --.
Line 37, "its" should read -- it is --.
Line 44, "finished the same" should read -- finished in the same --.
Line 54, "a long" should read -- along --.

Column 6,
Line 53, "one and end" should read -- one end --.

Signed and Sealed this

Twenty-first Day of June, 2005

JON W. DUDAS
*Director of the United States Patent and Trademark Office*